US010443309B2

(12) United States Patent
Gajji et al.

(10) Patent No.: US 10,443,309 B2
(45) Date of Patent: Oct. 15, 2019

(54) DYNAMIC GEO-STATIONARY ACTUATION FOR A FULLY-ROTATING ROTARY STEERABLE SYSTEM

(71) Applicant: HALLIBURTON ENERGY SERVICES, INC., Houston, TX (US)

(72) Inventors: Bhargav Gajji, Pune (IN); Rahul R. Gaikwad, Solapur (IN); Ratish Kadam, Pune (IN); Ankit Purohit, Barnagar (IN)

(73) Assignee: Halliburton Energy Services, Inc., Houston, TX (US)

( * ) Notice: Subject to any disclaimer, the term of this patent is extended or adjusted under 35 U.S.C. 154(b) by 256 days.

(21) Appl. No.: 14/888,547

(22) PCT Filed: Jun. 4, 2013

(86) PCT No.: PCT/US2013/044015
§ 371 (c)(1),
(2) Date: Nov. 2, 2015

(87) PCT Pub. No.: WO2014/196958
PCT Pub. Date: Dec. 11, 2014

(65) Prior Publication Data

US 2016/0090789 A1 Mar. 31, 2016

(51) Int. Cl.
*E21B 7/06* (2006.01)
*E21B 7/10* (2006.01)
*E21B 47/024* (2006.01)

(52) U.S. Cl.
CPC ..... *E21B 7/10* (2013.01); *E21B 7/06* (2013.01); *E21B 7/062* (2013.01); *E21B 7/067* (2013.01); *E21B 47/024* (2013.01)

(58) Field of Classification Search
CPC ..... E21B 7/10; E21B 7/06; E21B 7/04; E21B 7/062; E21B 7/067
See application file for complete search history.

(56) References Cited

U.S. PATENT DOCUMENTS 6,092,610 A 7/2000 Kosmala et al.
6,109,370 A 8/2000 Gray
(Continued)

FOREIGN PATENT DOCUMENTS

EP 1008717 A1 6/2000
GB 2425790 A 11/2006
(Continued)

OTHER PUBLICATIONS

Office Action issued in related GB Application No. 1705756.3, dated May 25, 2017 (6 pages).
(Continued)

*Primary Examiner* — Taras P Bemko
*Assistant Examiner* — Brandon M Duck
(74) *Attorney, Agent, or Firm* — Alan Bryson; Baker Botts L.L.P.

(57) ABSTRACT

The present disclosure describes a dynamic geo-stationary actuation technique that may be incorporated into a rotary steerable system 200. An example method described herein may include receiving a first angular orientation of a rotating housing 201 disposed in a borehole. The first angular orientation may be received from a sensor assembly 205 coupled to the housing 201, and the housing 201 may be coupled to a drill bit 203. A desired drilling direction for the drill bit 203 may also be received. A first trigger signal to a first actuator 206 coupled to the rotating housing 21 may be generated based, at least in part, on the first angular orientation and the desired drilling direction.

16 Claims, 4 Drawing Sheets

(56) References Cited

U.S. PATENT DOCUMENTS

| | | | | |
|---|---|---|---|---|
| 6,116,354 | A | 9/2000 | Buytaert | |
| 6,158,529 | A | 12/2000 | Dorel | |
| 6,315,062 | B1 | 11/2001 | Alft et al. | |
| 6,470,974 | B1 | 10/2002 | Moore et al. | |
| 7,360,610 | B2 | 4/2008 | Hall et al. | |
| 7,510,027 | B2 | 3/2009 | Weston et al. | |
| 8,185,312 | B2 * | 5/2012 | Ekseth | E21B 7/067 702/7 |
| 2006/0249287 | A1 | 11/2006 | Downton et al. | |
| 2012/0018225 | A1 * | 1/2012 | Peter | E21B 7/067 175/61 |
| 2014/0110178 | A1 * | 4/2014 | Savage | E21B 47/02 175/76 |
| 2016/0053543 | A1 * | 2/2016 | Diaz | E21B 7/062 |

FOREIGN PATENT DOCUMENTS

| | | | |
|---|---|---|---|
| GB | 2486811 | A | 6/2012 |
| WO | 20121012624 | A1 | 1/2012 |

OTHER PUBLICATIONS

International Search Report and Written Opinion issued in related PCT Application No. PCT/US2013/044015 dated Feb. 12, 2014, 13 pages.

* cited by examiner

DYNAMIC GEO-STATIONARY ACTUATION FOR A FULLY-ROTATING ROTARY STEERABLE SYSTEM

CROSS-REFERENCE TO RELATED APPLICATION

The present application is a U.S. National Stage Application of International Application No. PCT/US2013/044015 filed Jun. 4, 2013, which is incorporated herein by reference in its entirety for all purposes.

BACKGROUND

The present disclosure relates generally to well drilling operations and, more particularly, to dynamic geo-stationary actuation for a fully-rotating rotary steerable system.

As well drilling operations become more complex, and hydrocarbon reservoirs correspondingly become more difficult to reach, the need to precisely locate a drilling—both vertically and horizontally—in a formation increases. Part of this operation requires steering the drilling assembly, either to avoid particular formations or to intersect formations of interest. Steering the drilling assembly includes changing the direction in which the drilling assembly/drill bit is pointed. In a typical "Point-the-Bit" system, changing the direction in which the drilling assembly/drill bit is pointed includes exerting a force on a flexible drive shaft connected to a drill bit. In a typical "Push-the-Bit" system, changing the direction in which the drilling assembly/drill bit is pointed includes exerting a force on the borehole wall. In both Point-the-Bit and Push-the-Bit systems, a geo-stationary housing or other counter-rotating element may be used to maintain an orientation within the borehole. The use of these geo-stationary housings or other counter-rotating elements can decrease the longevity of the drilling assembly.

FIGURES

Some specific exemplary embodiments of the disclosure may be understood by referring, in part, to the following description and the accompanying drawings.

Figure 1:
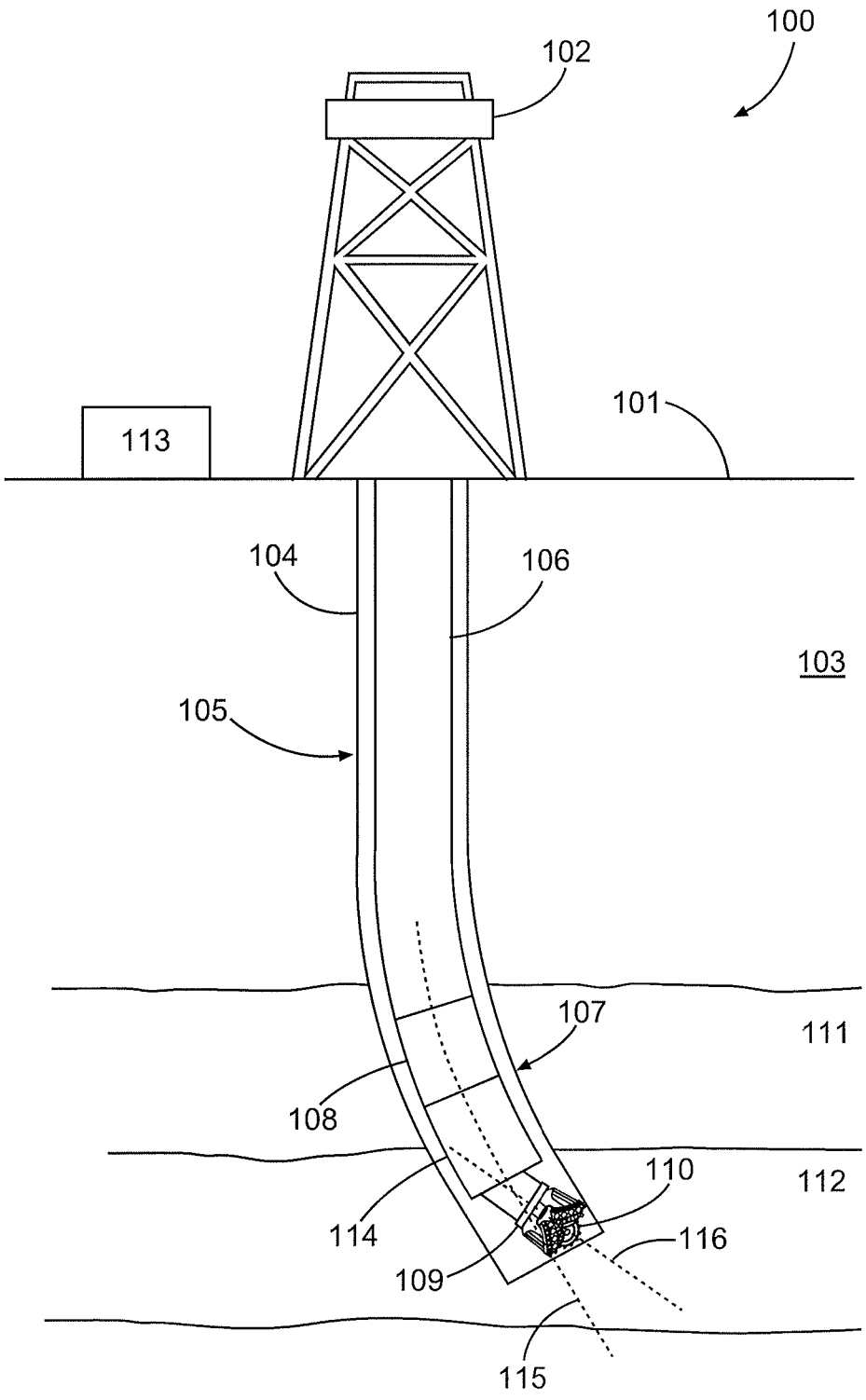
FIG. 1 is a diagram illustrating an example drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to dynamic geo-stationary actuation for a fully-rotating rotary steerable system.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

Systems and methods for dynamic geo-stationary actuation for a fully-rotating rotary steerable system as described herein. According to aspects of the present disclosure, example dynamic geo-stationary actuation techniques may be incorporated into both Push-the-Bit and Point-the-Bit type steering systems as well as into any other downhole drilling tool which requires steering the bit, without requiring a geo-stationary housing or a counter-rotating element. As used herein, the term geo-stationary may mean at a consistent rotational position with respect to a stationary reference point, such as the earth or a borehole within a formation. As would be appreciated by one of ordinary skill in view of this disclosure, the dynamic geo-stationary actuation systems and methods described herein may be incorporated into a non-rotating, geo-stationary housing, instead of housings that are rotationally fixed relative to a drill string, as described below. Likewise, although the dynamic geo-stationary actuation systems and methods described below are shown incorporated into convention drilling systems, similar dynamic geo-stationary actuation systems and methods may be incorporated into other types of drilling systems—such as coil tubing, well bore intervention, and other remedial operations—without departing from the scope of this disclosure.

FIG. 1 is a diagram illustrating an example drilling system 100, according to aspects of the present disclosure. The drilling system 100 includes a rig 102 mounted at the surface 101 and positioned above borehole 104 within a subterranean formation 103. In the embodiment shown, a drilling assembly 105 may be positioned within the borehole 104 and may be coupled to the rig 102. The drilling assembly 105 may comprise drill string 106 and bottom hole assembly (BHA) 107. The drill string 106 may comprise a plurality of segments threadedly connected. The BHA 107 may comprise a drill bit 109, a measurement-while-drilling (MWD) apparatus 108 and a steering assembly 114. The steering assembly 114 may control the direction in which the borehole 104 is being drilled. As will be appreciated by one of ordinary skill in the art in view of this disclosure, the borehole 104 will be drilled in the direction perpendicular to the tool face 110 of the drill bit 109, which corresponds to the longitudinal axis 116 of the drill bit. In a Point-the-Bit type assembly, controlling the direction in which the borehole 104 is drilled may include controlling the longitudinal axis 116 of the drill bit 109 independently of and relative to the longitudinal axis 115 of the BHA 107. In a Push-the-Bit type assembly, the longitudinal axis 115 of the BHA 107 and the longitudinal axis 116 of the drill bit 109 may be substantially the same, and controlling the direction in which the borehole 104 is drilled may include altering both the longitudinal axis 115 and the longitudinal axis 116 together.

Figure 2A:
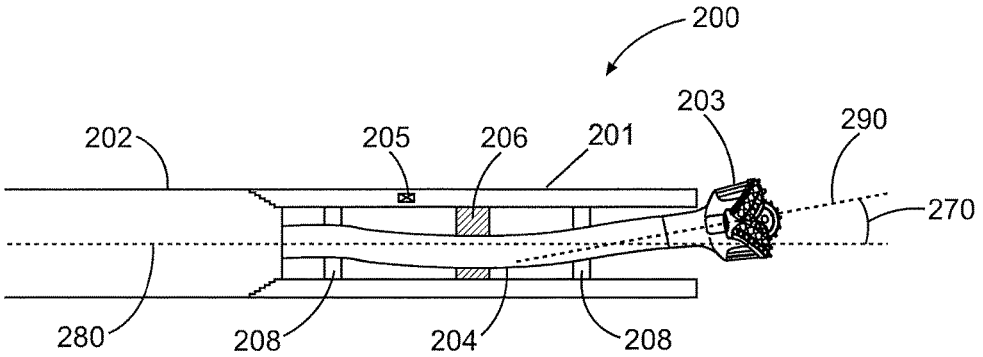
FIGS. 2A-2C are diagrams illustrating an example steering assembly, according to aspects of the present disclosure.
Figure 2B:
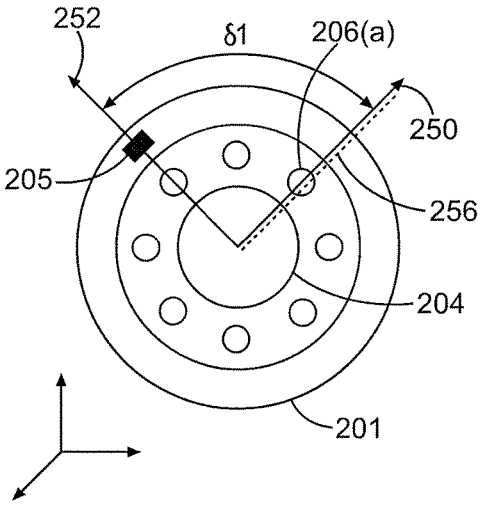
Figure 2C:
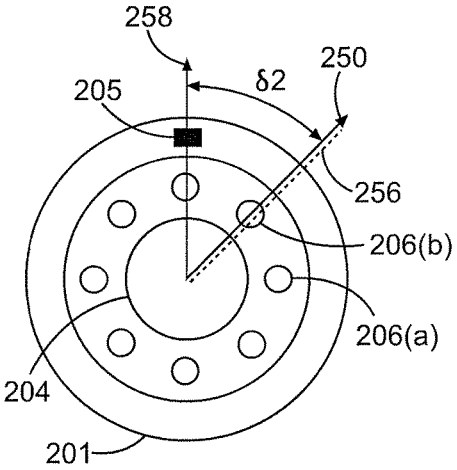

FIGS. 2A-2C are diagrams illustrating an example steering assembly 200 in a Point-the-Bit type drilling assembly, according to aspects of the present disclosure. In certain embodiments, some or all of the steering assembly 200 may be included in a drilling assembly similar to drilling assembly 105 in FIG. 1. The steering assembly 200 may include a housing or collar 201 coupled to a drill string 202. In certain embodiments, the housing 201 may be coupled to a portion of a BHA, such as a measurement-while-drilling (MWD) apparatus, instead of being coupled to a drill string 202. The housing 201 may be rotationally fixed relative to the drill string 202, such that it rotates with the same speed and direction as the drill string 202. In the embodiment shown, the housing 201 is coupled to the drill string 202 via threaded engagement 207, but other coupling mechanisms are possible within the scope of this disclosure.

In certain embodiments, the steering assembly 200 may comprise a drill bit 203 coupled to the housing 201. The coupling may either be direct, or indirect, such as through the drill string 202 via a bendable drive shaft 204. The drive shaft 204 may impart rotation from the drill string 202 to the drill bit 203. Focal points 208 may maintain portions of the drive shaft 204 centered within the housing 201, allowing the drive shaft 204 to bend at a point between the focal points 208. As the drill string 202 rotates, the housing 201, drill bit 203, and drive shaft 204 may rotate at the same speed and direction as the drill string 202. When rotating, the housing 201 may rotate about its longitudinal axis 280, and the drill bit 203 may rotate around its longitudinal axis 290 and the longitudinal axis 280 of the housing 201. In the embodiment shown, a drilling direction of the drill bit 203 may have two components: inclination, which corresponds to an offset angle 270 between the longitudinal axis 290 of the drill bit 203 and the longitudinal axis 280 of the housing 201, and azimuthal direction, which corresponds to the angular orientation of the drill bit 203 relative to the longitudinal axis 280 of the housing 201.

According to aspects of the present disclosure, the steering assembly 200 may further include at least one actuator coupled to the housing 201. The embodiment shown includes a plurality of actuators 206 within an internal bore of the housing 201. As will be described below, the actuators 206 may be selectively and independently triggered as the housing 201 rotates to cause the drill bit 203 and the longitudinal axis 290 of the drill bit 203 to correspond to a desired drilling direction. For example, the actuators 206 may alter or maintain offset angle 270, and may also maintain the drill bit 203 in a geo-stationary position as the drill string 202 rotates. The actuators 206 may take a variety of configurations—including electromagnetic actuators, piezoelectric actuators, hydraulic actuators, etc.—and be powered through a variety of mechanisms.

The steering assembly 200 may further include a sensor assembly 205 coupled to the housing 201. In the embodiment shown, the steering assembly 205 comprises an Inertial Measurement Unit (IMU) 205. Although the IMU 205 is shown coupled to the housing 201, it may be located in other positions along the drill string 202 or within a BHA generally in other embodiments. The IMU 205 may comprise an electronic device that measures at least one directional characteristics of the element to which it is coupled or attached. For example, directional characteristics may include the angular velocity, angular orientation, and gravitational forces of the housing 201.

In certain instances, the IMU 205 may include some combination of an integrated gyroscope, accelerometer, magnetometer, or global positioning sensor. In the embodiment shown, the IMU 205 may measure the directional characteristics of the housing 201 with respect to a virtual stationary reference. The virtual stationary reference system may be set, for example, before the actuation system is deployed downhole, such that a geo-stationary housing is not necessary to measure the relative position of the actuation system 200. In certain embodiments, the IMU 205 may calculate the directional characteristics incrementally from the virtual stationary reference point. In other embodiments, such as when the IMU 205 includes a magnetometer and/or a global positioning sensor, the IMU 205 may calculate the directional characteristics in absolute terms with respect to earth's coordinate system. Additionally, although one IMU 205 is shown in FIGS. 2A-2C, multiple IMUs 205 may be spaced circumferentially around the housing 201 to provide for reliable and redundant measurements.

FIGS. 2B and 2C are diagrams illustrating a cross section of steering assembly 201 at two different times during the rotation of the drill string 202 and housing 201. As can be seen and will be discussed, FIG. 2B illustrates a first actuator 206(*a*) triggered at a first time based on a first angular orientation 252 of the housing 201/IMU 205 and a desired drilling direction 250, and FIG. 2C illustrates a second actuator 206(*b*) triggered at a second time based on a second angular orientation 254 of the housing 201/IMU 205 and the desired drilling direction 250. Notably, the first actuator 206(*a*) and the second actuator 206(*b*) may be at a substantially similar angular orientation 256 with respect to a borehole, i.e., geo-stationary, when they are triggered.

In the embodiment shown, the actuators 206(*a*) and 206(*b*) are coupled to an interior surface of the housing 201 and disposed around the drive shaft 204. The actuators 206(*a*) and 206(*b*) may be positioned to contact and "bend" the drive shaft 204 when triggered. The actuators 206(*a*) and 206(*b*) may be triggered, for example, when they receive a trigger signal from a control unit, as will be described below. The bend in the drive shaft 204 may create the offset angle 270, and the size of the offset angle 270 may be a function of the amount of bend and the amount of force applied to the drive shaft 204 by the actuators. Accordingly, the actuators 206(*a*) and 206(*b*) may be triggered to control the inclination of the drill bit 203. Likewise, the angular orientation of the actuators 206(*a*) and 206(*b*) when they are triggered may control the angular orientation of the bend and therefore the azimuthal orientation of the drill bit 203.

In FIG. 2B, the housing 201 may be at a first angular orientation, represented by the angular orientation 252 of the IMU 205. As described above, the angular orientation 252 of the IMU 205 may be determined with reference to a virtual stationary reference configured before the steering assembly 200 is deployed downhole. A desired drilling direction 250 may be determined at the surface, for example, based on a formation survey, and may remain constant despite the rotation of the housing 201. The actuator 206(*a*) may be triggered based, at least in part, on the first angular orientation 252 and the desired drilling direction 250. For example, in the embodiment shown, the actuator 206(*a*) may be triggered based on a first angular difference δ1 between the angular orientation 252 and the desired drilling direction 250. Specifically, the actuator 206(*a*) may be associated with the first angular difference δ1 such that the actuator 206(*a*) is triggered whenever the rotation of the housing 201 causes the angular difference to approach the first angular difference δ1.

In FIG. 2C, the housing 201 may be at a second angular orientation, represented by the angular orientation 258 of the IMU 205. As described above, the angular orientation 258 of the IMU 205 may be determined with reference to a virtual stationary reference configured before the steering assembly 200 is deployed downhole. The desired drilling direction 250 may be the same as it is in FIG. 2B. The actuator 206(*b*) may be triggered based, at least in part, on the second angular orientation 258 and the desired drilling direction 250. For example, in the embodiment shown, the actuator 206(*b*) may be triggered based on a second angular difference δ2 between the angular orientation 258 and the desired drilling direction 250. Specifically, the actuator 206(*a*) may be associated with the second angular difference δ2 such that the actuator 206(*b*) is triggered whenever the rotation of the housing 201 causes the angular difference to approach the second angular difference δ2. Notably, the actuator 206(*a*) may not be triggered because it is not associated with the second angular difference δ2.

Each of the actuators 206 may be associated with a different angular difference δ between the housing 201/IMU 205 and a desired drilling direction. In the embodiment shown, actuator 206(*a*) and 206(*b*) are associated with first and second angular differences such they are triggered at a substantially similar angular orientation 256 that is generally equivalent to the desired drilling direction. In other embodiments, such as in FIGS. 3A-3B, for example, actuators may be associated with different angular differences such that they are triggered at substantially the same angular orientation, but at an angular orientation that is not equivalent to the desired drilling direction.

Figure 3A:
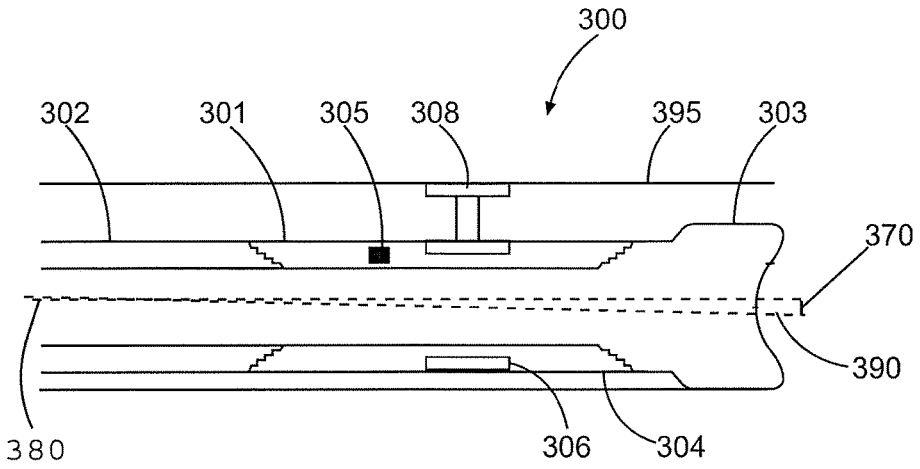
FIGS. 3A-3C are diagrams illustrating an example steering assembly, according to aspects of the present disclosure.
Figure 3B:
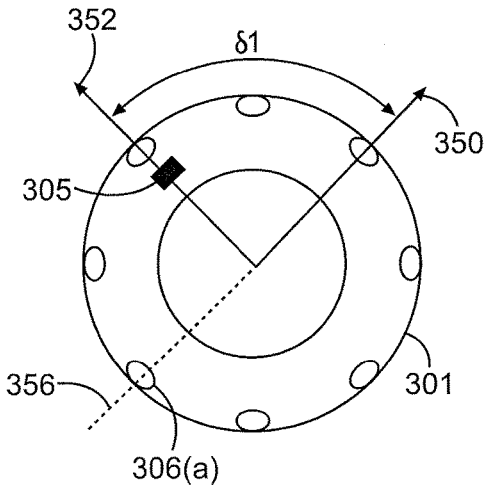
Figure 3C:
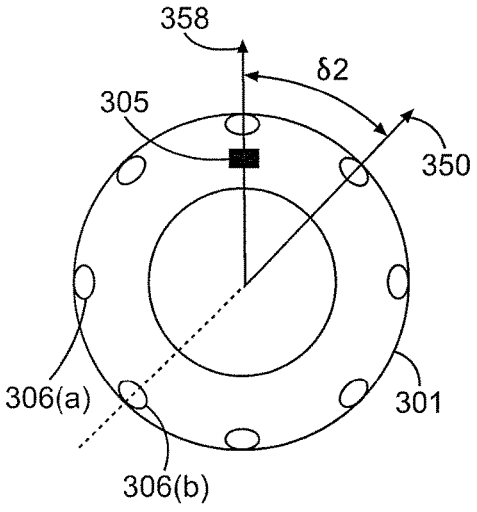

FIGS. 3A-3C are diagrams illustrating an example steering assembly 300 in a Push-the-Bit type drilling assembly, according to aspects of the present disclosure. The actuation system 300 may include a housing or collar 301 coupled to a drill string 302. In certain embodiments, the housing 301 may be coupled to a portion of a BHA, such as a measurement-while-drilling (MWD) apparatus, instead of being coupled to a drill string 302. The housing 301 may be rotationally fixed relative to the drill string 302, such that it rotates with the same speed and direction as the drill string 302. In the embodiment shown, the housing 301 is coupled to the drill string 302 via threaded engagement 307, but other coupling mechanisms are possible within the scope of this disclosure.

In certain embodiments, the steering assembly 300 may comprise a drill bit 303 coupled to the housing 301. The housing 301 may impart rotation from the drill string 302 to the drill bit 303. In the embodiment shown, the rotation may be imparted through a threaded connection between the drill bit 303 and the housing 301. As the drill string 302 rotates, the housing 301 and drill bit 303 may rotate at the same speed and direction as the drill string 302. The housing 301 and drill bit 303 may rotate about a longitudinal axis 390. In the embodiment shown, a drilling direction of the drill bit 303 may have two components: inclination, which corresponds to an offset angle 370 between the longitudinal axis 390 of the drill bit 303 and the longitudinal axis 380 of the borehole 395, and azimuthal direction, which corresponds to the angular orientation of the drill bit 303 relative to the longitudinal axis 380 of the borehole 395.

According to aspects of the present disclosure, the steering assembly 300 may further include at least one actuator coupled to the housing 301. The embodiment shown includes a plurality of actuators 306 coupled to an exterior surface of the housing 301. As will be described below, the actuators 306 may be selectively and independently triggered as the housing 301 rotates to cause the drill bit 303 and the longitudinal axis 390 of the drill bit 303 to correspond to a desired drilling direction. For example, the actuators 306 may alter or maintain offset angle 370, and may also maintain the drill bit 303 in a geo-stationary position with respect to the borehole 395 as the drill sting 302 rotates. The actuators 306 may take a variety of configurations—including electromagnetic actuators, piezoelectric actuators, hydraulic actuators, etc.—and be powered through a variety of mechanisms.

The steering assembly 300 may further include a sensor assembly 305 coupled to the housing 301. In the embodiment shown, the steering assembly 305 comprises an Inertial IMU 305. The IMU 305 may have a similar configuration and function in a similar manner to the IMU 205 described above.

FIGS. 3B and 3C are diagrams illustrating a cross section of steering assembly 301 at two different times during the rotation of the drill string 302 and housing 301. As can be seen and will be discussed, FIG. 3B illustrates a first actuator 306(*a*) triggered at a first time based on a first angular orientation 352 of the housing 301/IMU 305 and a desired drilling direction 350, and FIG. 3C illustrates a second actuator 306(*b*) triggered at a second time based on a second angular orientation 358 of the housing 301/IMU 305 and the desired drilling direction 350. Notably, the first actuator 306(*a*) and the second actuator 306(*b*) may be at a substantially similar angular orientation 356 with respect to a borehole, i.e., geo-stationary, when they are triggered.

In the embodiment shown, the actuators 306(*a*) and 306(*b*) are coupled to an interior surface of the housing 301 and disposed around the drive shaft 304. The actuators 306(*a*) and 306(*b*) may include pads or blades 308 that contact a wall of the borehole 395 when triggered. By contacting the wall of the borehole 395, the pad 308 may apply a force to the side of the housing 301, deflecting the housing 301 and drill bit 303. The deflection may create the offset angle 370, and the size of the offset angle 370 may be a function of the amount of deflection caused by the actuators 306(*a*) and 306(*b*). Accordingly, the actuators 306(*a*) and 306(*b*) may be triggered to control the inclination of the drill bit 303. Likewise, the angular orientation of the actuators 306(*a*) and 306(*b*) when they are triggered may control the angular orientation of the deflection and therefore the azimuthal orientation of the drill bit 303.

In FIG. 3B, the housing 301 may be at a first angular orientation, represented by the angular orientation 352 of the IMU 305. As described above, the first angular orientation 352 of the IMU 305 may be determined with reference to a virtual stationary reference configured before the steering assembly 300 is deployed downhole. A desired drilling direction 350 may be determined at the surface, for example, based on a formation survey, and may remain constant despite the rotation of the housing 301. The actuator 306(*a*) may be triggered based, at least in part, on the first angular orientation 352 and the desired drilling direction 350. For example, in the embodiment shown, the actuator 306(*a*) may be triggered based on a first angular difference δ1 between the first angular orientation 352 and the desired drilling direction 350. Specifically, the actuator 306(*a*) may be associated with the first angular difference δ1 such that the actuator 306(*a*) is triggered whenever the rotation of the housing 301 causes the angular difference to approach the first angular difference δ1.

In FIG. 3C, the housing 301 may be at a second angular orientation, represented by the angular orientation 358 of the IMU 305. As described above, the angular orientation 358 of the IMU 305 may be determined with reference to a virtual stationary reference configured before the steering assembly 300 is deployed downhole. The desired drilling direction 350 may be the same as it is in FIG. 2B. The actuator 306(*b*) may be triggered based, at least in part, on the second angular orientation 358 and the desired drilling direction 350. For example, in the embodiment shown, the actuator 306(*b*) may be triggered based on a second angular difference δ2 between the angular orientation 358 and the desired drilling direction 350. Specifically, the actuator 306(*a*) may be associated with the second angular difference δ2 such that the actuator 306(*b*) is triggered whenever the rotation of the housing 301 causes the angular difference to approach the second angular difference δ2. Notably, the actuator 306(*a*) may not be triggered because it is not associated with the second angular difference δ2.

In the embodiment shown, the first actuator 306(*a*) and the second actuator 306(*b*) may be triggered at substantially the same angular orientation 356. Unlike steering assembly 200, however, the orientation 356 is 180 degrees opposite from the desired drilling direction 350, rather than substantially the same as the desired drilling direction 350. The angular orientation at which the actuators are triggered are different than in steering assembly 300 because the deflection functionality of the steering assembly 300 is different than the bend functionality of the steering assembly 200. The angular differences associated with each actuator, and the angular orientation at which they are triggered, may be altered to correspond with the many different steering functionalities within the scope of this disclosure.

Figure 4:
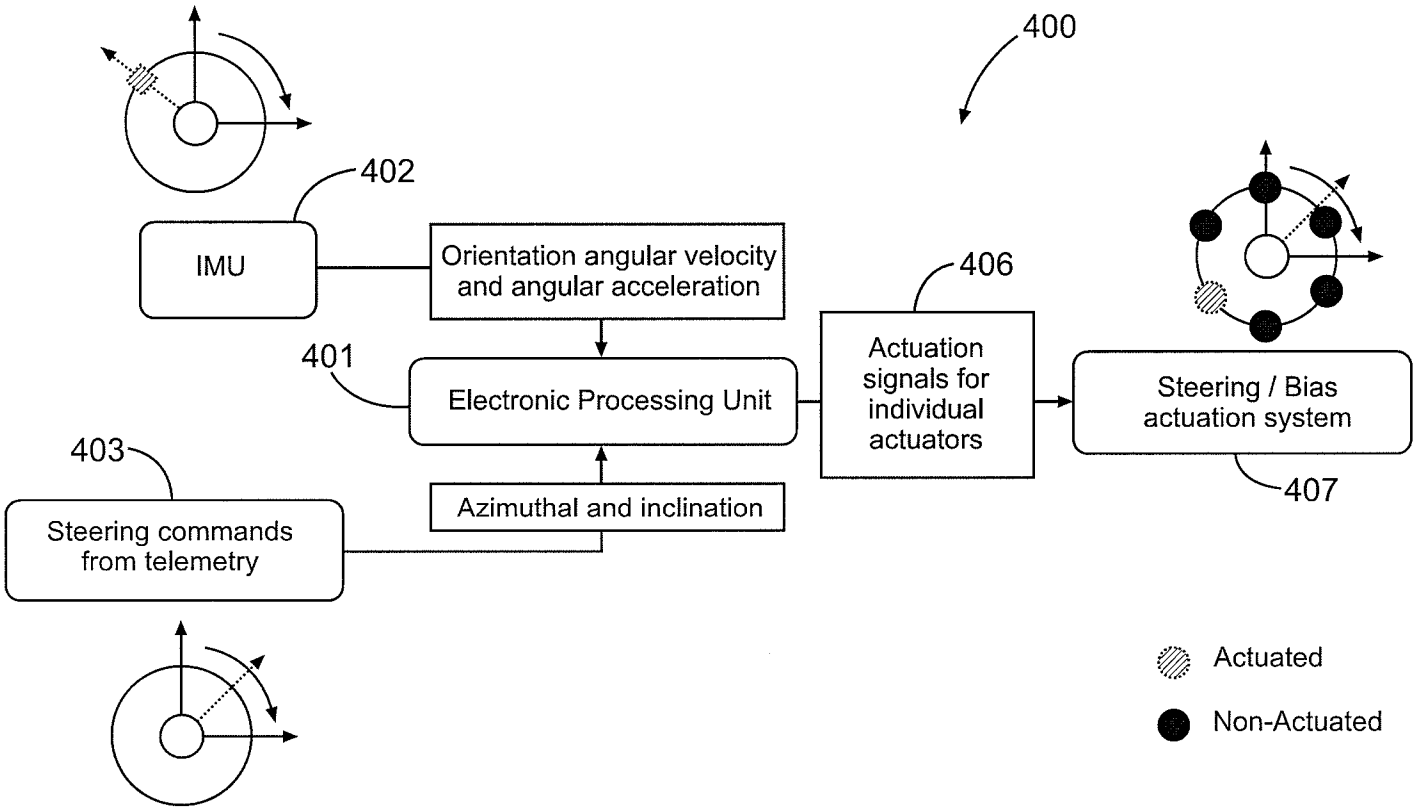
FIG. 4 is a diagram illustrating an example actuation control system, according to aspects of the present disclosure.

FIG. 4 is a diagram illustrating an example actuation control system 400, according to aspects of the present disclosure. The control system 400 may comprise a processing unit 401. For purposes of this disclosure, a processing unit 401 may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, the processing unit 401 may include a processor or controller that is coupled to a memory device and a power source. The power source may comprise a downhole battery pack, and may provide power to the processing unit. The memory device may comprise a set of instructions that control the functionality of the microprocessor or controller.

The processing unit 401 may be communicably coupled to sensor assembly 402, such as an IMU, coupled to a housing. The housing may be coupled to a drill bit and may be rotating as part of a downhole drilling operation. The IMU 402 may continuously sense at least one directional characteristic of the housing—such as its angular orientation, velocity and acceleration—and transmit the directional characteristic to the processing unit 401. The processing unit 401 may receive a directional characteristic, such as a first angular orientation of the housing, from the IMU 402. The processing unit 402 may also receive a desired drilling direction. In certain embodiments, the processing unit 402 may receive the desired drilling direction from a downhole telemetry system 403, which may be communicably coupled to the processing unit 401. Example telemetry systems may include downhole controllers that communicate downhole measurement data with and receive commands from a surface controller via mud pulses or wired/wireless connections. The processing unit 401 may receive commands from the surface controller through the downhole telemetry system. In certain embodiments, these commands may include the desired drilling direction of the drilling assembly, including the azimuthal direction and the inclination.

The processing unit 401 may generate a first trigger signal 406 to a first actuator coupled to the rotating housing based, at least in part, on the first angular orientation of the housing and the desired drilling direction. The processing unit 401 may be communicably coupled to the actuators in a steering assembly 407 and may transmit the first trigger signal to the steering assembly 407 such that the first actuator is individually triggered. In certain embodiments, the processing unit 401 may further determine a first angular difference between the desired drilling direction and the first angular orientation, and may generate the first trigger signal if the first actuator is associated with the first angular difference.

In certain embodiments, the processing unit 401 may account for the angular speed and acceleration of the rotating housing when generating the first trigger signal. For example, the processing unit 401 may generate the first trigger signal to account for the movement of the rotating housing so that the first actuator is triggered at the correct angular orientation.

The processing unit 401 may continue to receive angular orientation measurements from the IMU 402 and may also receive an updated desired drilling direction from the telemetry system 403. Likewise, the processing unit 401 may continue to generate trigger signals for each of the actuators in the steering assembly 407 based on the received angular orientations and the received desired drilling directions.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the elements that it introduces. Additionally, the terms "couple" or "coupled" or any common variation as used in the detailed description or claims are not intended to be limited to a direct coupling. Rather, two elements may be coupled indirectly and still be considered coupled within the scope of the detailed description and claims.

What is claimed is:

1. A method for dynamic geo-stationary actuation, comprising:

receiving a first angular orientation of a rotating housing disposed in a borehole from a sensor assembly coupled to the housing, wherein the housing is coupled to a drill bit, wherein the first angular orientation is with respect to a virtual stationary reference configured before the rotating housing is disposed in the borehole;

receiving a second angular orientation of the rotating housing from the sensor assembly, wherein the second angular orientation corresponds to a different time than the first orientation;

receiving a desired drilling direction for the drill bit, wherein the desired drilling direction is determined at a surface, and wherein the desired drilling direction remains constant despite rotation of the housing; and generating a first trigger signal to a first actuator coupled to the rotating housing based, at least in part, on the first angular orientation and the desired drilling direction, wherein the first actuator is disposed within a bore of the rotating housing, wherein a drive shaft is within the rotating housing and coupled to the drill bit;

generating a second trigger signal to a second actuator coupled to the rotating housing based, at least in part, on the second angular orientation and the desired drilling direction;

selectively and independently triggering the first actuator based on the first trigger signal; and selectively and independently triggering the second actuator based on the second trigger signal.

2. The method of claim 1, wherein the sensor assembly comprises an Inertial Measurement Unit (IMU).

3. The method of claim 1, wherein receiving the desired drilling direction for the drill bit comprises receiving the desired drilling direction through a downhole telemetry system.

4. The method of claim 1, further comprising determining a first angular difference between the desired drilling direction and the first angular orientation.

5. The method of claim 4, wherein generating the first trigger signal to the first actuator comprises generating the first trigger signal to the first actuator if the first actuator is associated with the first angular difference.

6. The method of claim 1, further comprising determining a second angular difference between the desired drilling direction and the second angular orientation.

7. The method of claim 6, wherein generating the second trigger signal to the second actuator comprises generating the second trigger signal to the second actuator if the second actuator is associated with the second angular difference.

8. The method of claim 7, wherein the first actuator and the second actuator are located at a substantially similar angular orientation with respect to the borehole when the first trigger signal and the second trigger signal are respectively generated.

9. An apparatus for dynamic geo-stationary actuation, comprising:

a housing;

a first actuator coupled to the housing;

a second actuator coupled to the housing;

a sensor assembly coupled to the housing; and a control unit in communication with the first actuator and the sensor assembly, wherein the control unit comprises a processor and a memory device containing a set of instructions that, when executed by the processor, cause the processor to receive from the sensor assembly a first angular orientation of the housing while the housing is rotating, wherein the first angular orientation is with respect to a virtual stationary reference configured before the rotating housing is disposed in the borehole;

receive from the sensor assembly a second angular orientation of the housing while the housing is rotating, wherein the second angular orientation corresponds to a different time than the first orientation;

receive a desired drilling direction for a drill bit coupled to the housing, wherein the desired drilling direction is determined at a surface, and wherein the desired drilling direction remains constant despite rotation of the housing; and generate a first trigger signal to the first actuator based, at least in part, on the first angular orientation and the desired drilling direction, wherein the first actuator is disposed within a bore of the rotating housing, wherein a drive shaft is within the rotating housing and coupled to the drill bit;

generate a second trigger signal to the second actuator based, at least in part, on the second angular orientation and the desired drilling direction;

selectively and independently trigger the first actuator based on the first trigger signal; and selectively and independently trigger the second actuator based on the second trigger signal.

10. The apparatus of claim 9, wherein the sensor assembly comprises an Inertial Measurement Unit (IMU).

11. The apparatus of claim 9, wherein the set of instructions that cause the processor to receive the desired drilling direction for the drill bit further cause the processor to receive the desired drilling direction through a downhole telemetry system in communication with the control unit.

12. The apparatus of claim 9, wherein the set of instructions further cause the processor to determine a first angular difference between the desired drilling direction and the first angular orientation.

13. The apparatus of claim 12, wherein the set of instructions that cause the processor to generate the first trigger signal to the first actuator further cause the processor to generate the first trigger signal to the first actuator if the first actuator is associated with the first angular difference.

14. The apparatus of claim 9, wherein the set of instructions further cause the processor to determine a second angular difference between the desired drilling direction and the second angular orientation.

15. The apparatus of claim 14, wherein the set of instructions that cause the processor to generate the second trigger signal to the second actuator further cause the processor to generate the second trigger signal to the second actuator if the second actuator is associated with the second angular difference.

16. The apparatus of claim 15, wherein the first actuator and the second actuator are located at a substantially similar angular orientation with respect to the borehole when the first trigger signal and the second trigger signal are respectively generated.

* * * * *